United States Patent [19]

Dutt

[11] Patent Number: 4,560,077

[45] Date of Patent: Dec. 24, 1985

[54] PLASTIC CLOSURE CAP

[75] Inventor: Herbert V. Dutt, Sarasota, Fla.

[73] Assignee: Sun Coast Plastics, Inc., Sarasota, Fla.

[21] Appl. No.: 654,084

[22] Filed: Sep. 25, 1984

[51] Int. Cl.[4] ..... B65D 53/00

[52] U.S. Cl. ..... 215/307; 215/344; 215/DIG. 1

[58] Field of Search ..... 215/344, DIG. 1, 307, 215/260, 270

[56] References Cited

U.S. PATENT DOCUMENTS

| | | | |
|---|---|---|---|
| 2,927,709 | 3/1960 | Hoffman et al. | 215/307 X |
| 3,215,297 | 11/1965 | Acton et al. | 215/43 |
| 3,255,907 | 6/1966 | Eddy | 215/344 X |
| 3,463,340 | 8/1969 | Lindstrom | 215/344 X |
| 4,143,785 | 3/1979 | Ferrell | 215/270 |
| 4,346,812 | 8/1982 | Banich | 215/352 |
| 4,415,096 | 11/1983 | Ohmi | 215/343 |
| 4,429,802 | 2/1984 | Marks | 215/344 |
| 4,442,947 | 4/1984 | Banich, Sr. | 215/344 |

*Primary Examiner*—Donald F. Norton

*Attorney, Agent, or Firm*—Jones, Tullar & Cooper

[57] ABSTRACT

A plastic closure cap particularly suited for use in situations which require a tight seal such as with carbonated beverage containers is disclosed. A pair of sealing flanges extend downwardly and outwardly from an inner surface of the top of the closure cap. These sealing flanges have a horizontal seal interference distance which increases with increased cap size to maintain an effective sealing function. Seal flange back up abutment surfaces are contacted by the free ends of the seal flanges and limit the deflection of the flanges thus causing the seal flanges to wrap around the container mouth as the cap is secured to the bottle. A load stop ring is positioned between, and separated from the seal flanges on the inner surface of the closure cap and contacts the container neck when the closure is in place. The sealing flanges include vent slots which increase the safety and convenience of the closure cap. Anti-doming ribs are also formed on the cap's inner top surface and prevent the cap from being forced outwardly into a convex shape by high pressure contents of a pressurized container to which the closure cap may be applied.

16 Claims, 3 Drawing Figures

PLASTIC CLOSURE CAP

FIELD OF THE INVENTION

The present invention is directed generally to a plastic closure cap. More particularly, the present invention is directed to a linerless plastic closure cap for use in applications which require a very tight seal such as on carbonated beverage containers. Most specifically, the present invention is directed to a linerless plastic cap having vented sealing flanges and sealing flange deflection limiting abutment surfaces. The sealing flanges are provided with spaced vent slots which function to gradually release the pressure in a carbonated beverage container to which the cap may be applied as the closure cap is removed. When the closure cap is applied to a container, the sealing flanges are deflected outwardly by engagement with the container neck and this deflection is limited by seal back up abutment surfaces. A load stop ring is also provided in the closure and prevents top load caused deflection of the seal flanges. The closure further includes anti-doming ribs and is dimensioned to provide the requisite amount of horizontal seal interference between the container neck finish and the seal flanges to insure a proper seal thus providing a closure cap useable on a wide variety of containers.

DESCRIPTION OF THE PRIOR ART

Plastic linerless screw type closures for various containers are generally known in the art, as may be seen, for example, in U.S. Pat. No. 4,143,785 to Ferrell which is assigned to the assignee of the present invention. Container closures of this general type typically include a planar top surface and a generally cylindrical downwardly extending side wall which is internally threaded. A pair of spaced sealing flaps or flanges extend downwardly from the inner surface of the top portion of the cap and sealingly engage the upper surface of the container neck finish when the closure is placed on the bottle and screwed down.

Although closures of this general type have been found to be quite satisfactory in closing containers whose interiors are at neutral pressure or are under a vacuum, these closures have not been as successful in applications which require a very tight seal such as in pressurized package containers. It would appear that one of the causes of seal leakage has been due to seal flange deflection caused by the pressure of the contents. In an effort to rectify this problem, there have been developed seal engaging abutments such as may be seen in U.S. Pat. No. 4,442,947 to Banich. While the provision of seal flange engaging abutments has increased the effectiveness of the seal, problems of seal failure and leakage have not been completely eliminated.

Another cause of seal failures in various container closure applications has been seal flange deflection caused by top loading of the closure cap. Design criteria promulgated by various users of plastic linerless closure caps specify that the closure must be able to withstand a top load of between 60 and 100 pounds without loss of container seal integrity. Such requirements have, in the prior art, been met by the use of thicker seal flanges or integral flange reinforcing members. Such approaches have not been particularly successful since they have adversely affected the ability of the seal flanges to properly contact the container neck finish and form a proper seal. The seal flanges must have sufficient flexibility to be able to form a good seal with the container. At the same time, the closure must have sufficient stiffness or strength to be able to withstand the specified top loading. Until the subject invention, it has been difficult to satisfactorily provide a closure having sufficient strength and the requisite seal flange flexibility.

As the closure is applied to the container and the seal flanges are deflected apart from each other by the upper portion of the container's mouth, there is formed a zone of contact between the inner surfaces of the seal flanges and the inner and outer edge surfaces of the container. While it had originally been believed that this contact area was typically a line or point contact, further analysis has shown that the area of contact is actually an annular band or surface resulting from the penetration of the container edges into the seal flanges. As the dimensions of the closure cap are varied to accommodate various sized containers, the width or thickness of this annular contact band or surface should be varied to provide a contact band width or area sufficient to maintain a proper seal. This width or areas will hereinafter be referred to as a horizontal seal interference width. A larger closure cap having a large diameter seal flange requires a larger horizontal seal interference width than does a smaller closure having a smaller diameter flange, assuming a generally constant flange thickness. The prior art seal flange assemblies have not taken this requirement into consideration and this has resulted in additional seal failures in some applications which require a very tight seal such as a pressurized containers.

The seal flanges shown in the prior art closure caps are continuous along their peripheries. While this has promoted positive sealing, it has also resulted in a sudden release of high pressure, when the closure is being used with a pressurized container, as the closure is removed. This sudden release of pressure can, under certain conditions, be sufficient to cause the container closure to be propelled away from the container with sufficient force to possibly cause an injury to the person opening the container. In a less severe situation, the sudden, rapid release of pressurization can cause the contents of the container to flow out of the container thereby wasting some of the contents and creating a spillage that must be cleaned up. The need thus exists for a closure having sealing flanges which will operate to provide a gentle, gradual release of the high internal pressure in a pressurized container on which the closure may be secured.

While the general concept of a plastic, linerless, screw threaded, container closure having sealing flanges is known in the art, various problems with these closures remain. The need exists for a closure utilizing sealing flanges that provides a reliable seal, that allows gradual venting of pressurized containers, that provides increased seal contact areas with increased cap size, that can withstand substantial top loading without seal failure and that is not complex or costly. The plastic closure cap in accordance with the present invention fulfills these needs in a simple, expeditious manner.

SUMMARY OF THE INVENTION

It is an object of the present invention to provide a plastic closure cap.

Another object of the present invention is to provide a plastic closure cap having sealing flanges.

A further object of the present invention is to provide a plastic closure cap having seal flange back up abutment surfaces.

Yet another object of the present invention is to provide a plastic closure cap having a load stop ring.

Still a further object of the present invention is to provide a plastic closure cap having vented sealing flanges.

Yet still another object of the present invention is to provide a plastic closure cap having a horizontal seal interference width which increases with increased cap size.

A still further object of the present invention is to provide a plastic closure cap having means to prevent doming of the cap.

As will be discussed in greater detail in the description of the preferred embodiment which is set forth hereinafter, the plastic closure cap in accordance with the present invention includes a pair of generally downwardly extending sealing flanges. As the closure is applied to the container, these sealing flanges are deflected outwardly and are forced away from each other by the mouth of the container. Seal back up flanges or abutments are spaced from the seal flanges and are contacted by the free ends of the flanges as they are forced outwardly. This engagement of each seal flange's outer or free end with the seal back up elements limits the outward deflection of the seal flanges and causes the seal flanges to wrap around the edges of the container mouth to thereby insure a good surface contact between the inner surfaces of the seal flanges and the container's neck finish areas without unduly restricting seal flexibility.

A load stop ring is formed on the plastic container closure between, and spaced from the downwardly depending seal flanges. This load stop ring engages the upper surface of the container neck finish when the closure is securely applied to the container. The load stop ring thus provides a solid contact between the closure and the container so that the top loading applied to the closure will not function to force the cap down further on the bottle, possibly disrupting the seal flange and neck finish engagement. Placement of the load stop ring between, but spaced from the seal flanges allows the ring to properly perform its intended function without having a detrimental effect on seal flange flexibility.

As the diameters of the seal flanges increase, as is the situation when the size of the cap is increased to accommodate larger mouthed containers, the flexibility of the seal flanges themselves increase, especially where seal flange thicknesses remain constant. This increase in seal flange flexibility causes less satisfactory seal performance as cap size is increased unless the sealing area is also increased. In accordance with the present invention, this problem is overcome by properly structuring the closure cap so that the horizontal seal intereference width or distance is increased as the diameter of the cap increases. This increased horizontal seal interference compensates for increased seal flange flexibility and provides a proper sealing effect as the cap size varies.

Each of the seal flanges has a plurality of vent slots or cut-outs along its lower, free end. These are spaced about the peripheries of the flanges and, in the preferred embodiment, each vent slot on one of the seal flanges is aligned with a cooperating vent slot on the other of the seal flanges. As the closure cap is removed from the mouth of a pressurized container, the vent slots allow partial release of the container's high internal pressure before the closure has been completely removed. This slower, more gradual pressure release is much safer than the more rapid and violent pressure release produced by the prior art devices thereby rendering the closure cap in accordance with the present invention safer when used on pressurized containers. The gradual pressure release afforded by the closure cap of the present invention is also less apt to cause agitation of the bottle's contents.

The plastic closure cap in accordance with the present invention provides a screw threaded closure structured to form a tight, dependable seal when applied to any container and a seal which is well suited for use with carbonated beverage containers. It provides seal flanges and cooperating seal back-up abutments that insure a good wrap around seal contact area without restricting seal flexibility. A top load support ring provides the requisite top load support strength without compromising seal flange flexibility. The seal flanges are structured and sized to compensate for variations in seal flange flexibility caused by cap size changes, and the flanges are further provided with vent slots which aid in the gradual release of high internal pressure when the closures are used with pressurized containers. The plastic closure cap in accordance with the present invention is effective and efficient while remaining relatively simple and uncomplicated in structure.

BRIEF DESCRIPTION OF THE DRAWINGS

While the novel features of the plastic closure cap in accordance with the present invention are set forth with particularity in the appended claims, a full and complete understanding of the invention may be had by referring to the description of the preferred embodiment, as set forth hereinafter, and as may be seen in the accompanying drawings, in which:

DESCRIPTION OF THE PREFERRED EMBODIMENT

Figure 1:
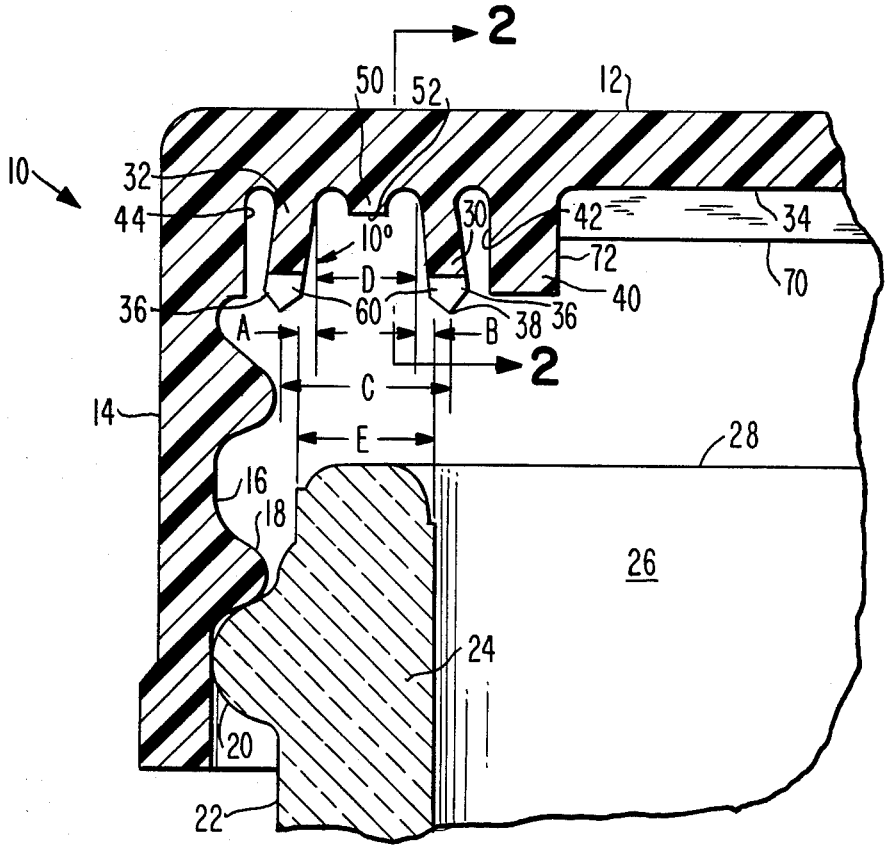
FIG. 1 is a sectional, side elevation view of a portion of a plastic closure cap in accordance with the present invention and showing the cap only partially secured to the container.

Referring initially to FIG. 1, there may be seen a preferred embodiment of a plastic closure cap, generally at 10 in accordance with the present invention. Plastic closure cap 10 is formed or molded from any suitable plastic composition and has a flat, generally circular top 12 and a downwardly depending, cylindrical side wall 14. The inner surface 16 of sidewall 14 may be provided with suitable internal screw threads 18. Suitable cooperating external screw threads 20 are formed on the outer peripheral surface 22 of a container neck 24 which terminates in an open mouth 26 defined by an upper, somewhat rounded neck finish surface 28. The container may be made of glass, plastic, or other suitable material and may be designed to hold a carbonated beverage.

A pair of spaced inner and outer sealing flanges 30 and 32, respectively, extend downwardly from an inner surface 34 of the top portion 12 of closure cap 10. As may be seen in FIG. 1, these sealing flanges are flaired slightly outwardly at an angle of generally about 10° from vertical and are therefore generally in the shape of a truncated cone. Each of these sealing flanges is also preferably slightly tapered in thickness and in the preferred embodiment has a thickness of generally about 0.030" at its point of attachment to the undersurface 34 of closure cap top 12, and a thickness of generally about 0.025" at a free end 36. It will be understood that these above recited dimensions as well as those to be set forth subsequently are given primarily for illustrative purposes and are subject to normal manufacturing tolerances which may be generally in the range of ±0.010" and ±5°.

Referring again to FIG. 1, several dimensional criteria will now be discussed. A horizontal seal interference distance A or B is shown as the horizontal spacing or offset between the point of attachment of the sealing surface side of each sealing flange 30 and 32 to surface 34 and the inner or outer surface of the container neck 24. Variation of this horizontal seal interference width or spacing is accomplished by moving the sealing flanges 30 and 32 toward or away from each other. Since the thickness of the container neck 24 remains constant over a range of bottle mouth sizes, movement of the sealing flanges 30 and 32 toward each other will increase the horizontal seal interference widths A and B. Conversely, moving the sealing flanges away from each other will reduce widths A and B. If A and B were reduce to a value of zero then the sealing flanges would be so widely spaced that they would not contact the neck finish 28 of the container. These horizontal seal interference distances A and B must always be a positive number for the sealing flanges 30 and 32 to contact the container.

Figure 3:
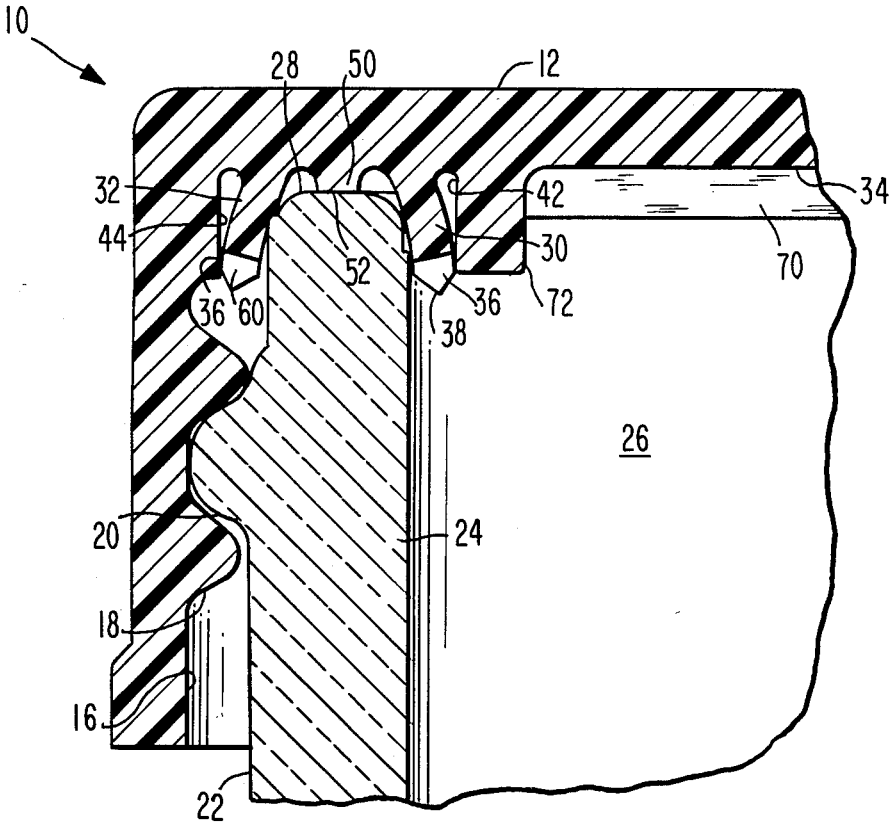
FIG. 3 is a sectional, side elevation view generally similar to FIG. 1 and showing the closure cap completely secured to the container.

As was alluded to previously, this horizontal seal interference distance or width must be increased as the size of the closure cap increases. Referring briefly to FIG. 3, it will be seen that the neck finish surface 28 of the container neck 26 engages the inner surfaces of seal flanges 30 and 32 and forces them outwardly. The contact between the container neck finish 28 and sealing flanges 30 and 32 is not a line contact but is more of a surface or band contact. As the size of the cap increases, which thereby increases the overall diameter of each of the seal flanges 30 and 32, and with a generally constant seal flange thickness over a certain range of cap sizes, it is necessary to increase the horizontal seal interference width A and B since the sealing flanges become more flexible with increased diameter or circumference so that a larger seal flange to container contact band area is necessary to provide a proper seal. The following dimensions are provided to exemplify the increase in horizontal seal interference width required by various cap sizes.

| Cap Size mm | 20 to 28 | 29 to 38 | over 38 |
|---|---|---|---|
| A or B Inches | .020 to .030 | .025 to .035 | .030 to 0.40 |

Several other dimensional relationships are also important for proper seal operation. As may again be seen in FIG. 1, the container neck 24 has a width indicated at E. The closure cap's sealing flanges terminate in tapered free ends 36, each of which tapers to an edge 38. The spacing between these free edges 38 can be seen at C and can be referred to as the maximum throat width of the seal flanges. Width C must be greater than container neck thickness E for the sealing flanges to be properly positioned on both sides of the neck finish 28, as see in FIG. 3. A minimum throat width is shown at D and is the spacing between the two seal flanges 30 and 32 at their points of attachment to inner surface 34 of closure cap top 12. The minimum throat width D must be less than width E for the sealing flanges to be deflected outwardly during seal formation. It is this spacing D which determines the horizontal seal interference distances A and B. It will be seen that the sum of A, B, and D equals width E.

Referring again to FIGS. 1 and 3 several additional important aspects of container closure cap 10 in accordance with the present invention will now be discussed in greater detail. An inner seal back up flange is shown generally at 40 and is in the shape of a downwardly depending flange positioned radially interiorly of inner seal flange 30 on surface 34 of closure cap top 12. This inner seal back up flange 40 is thicker than inner seal flange 30 and, in the preferred embodiment, has a thickness of generally about 0.035" the same as that of inner seal flange 30 and this length is in the range of generally 0.10". An abutment surface 42 is formed on inner seal back up flange 40 as the outer vertical peripheral surface of back up flange 40. This abutment surface 42 is spaced radially inwardly of the radial inner surface of free end 36 of inner seal flange 30 a distance of generally about 0.025".

An outer seal flange abutment surface 44 is formed as a thickened wall portion of closure cap side wall 14. The spacing between abutment surface 44 and the radially outer free end 36 of outer sealing flange 32 in the non-distorted mode seen in FIG. 1 is similar to that of inner seal flange 30 from inner seal flange abutment surface 42 and is also generally about 0.025". While the inner and outer seal flanges 30 and 32, respectively taper generally outwardly from their points of contact with inner surface 34 of cap top 12, the inner seal flange abutment surface 42 and the outer seal abutment surface 44 are generally vertical. Thus the spacing between surfaces 42 and 44 and inner and outer seal flanges 30 and 32 decreases as the distance away from cap inner surface 34 increases.

As the closure cap 10 is secured to container neck 24 by engagement of cap threads 18 with container threads 18, the container neck finish 28 is positioned between the sealing flanges 30 and 32 thereby causing them to deflect. After a certain amount of deflection, the sealing flanges 30 and 32 are again directed downwardly due to contact of their free ends 36 with abutment surfaces 42 and 44. It should be noted that it is the free ends 36 of inner and outer sealing flanges 30 and 32, respectively which contact their respective abutment surfaces 42 and 44. This contact positioning maximizes the wrap around effect between the seal flanges and the container neck finish 28, as may be seen in FIG. 3. The greater the area of surface contact between the sealing flanges 30 and 32 and the container neck surface 28, the more effective the seal that is formed will be. By placing the abutment surfaces 42 and 44 so that they will contact the sealing flanges 30, 32 generally at their free ends 36, the sealing flanges are allowed to deflect in a manner which provides a maximum of seal contact surface. Without the sealing flange abutment surfaces 42, 44, the sealing flanges 30, 32 would be free to be deflected by the container neck finish 28 in a manner which would result in only a line contact. Particularly when the container closure cap 10 is used with carbonated beverages that generate high internal pressures, the maximization of seal contact areas is of substantial importance. The cooperation of the seal flange free ends 36 with the seal flange abutment surfaces 42 and 44 provides this maximum surface area sealing flange to container neck finish contact.

A load stop ring, generally at 50 may be seen in FIGS. 1 and 3. Load stop ring 50 is formed integrally with inner surface 34 of closure cap top 12, and is located between, and separate from inner and outer seal flanges 30 and 32, respectively. In the preferred embodiment, load stop ring 50 has a height of generally about 0.020" to 0.025". As may be seen in FIG. 3, when closure cap 10 is secured to container neck 24, a lower, planar surface 52 of load stop ring 50 abuts the upper surface of container neck finish 28. As its name implies, the load stop ring 50 prevents a top load imposed on the cap 10 from moving the cap downwardly and thereby interfering with the function of the sealing flanges 30 and 32. If load stop ring 50 were omitted and with the minimum throat width D being less than container neck finish thickness E, an excessive top load applied to cap 10 could cause over-deflection of the seal flanges and seal malfunction. The load stop ring 50 prevents this. Load stop ring 50 is made separate from inner and outer sealing flanges 30 and 32 and thus does not hinder the flexibility of these sealing flanges. If the load stop ring 50 extended completely between the sealing flanges, it could compromise the ability of the sealing flanges to deflect thereby reducing the sealing surface area. Load stop ring 50 is given sufficient width to perform its intended function without interfering with the functioning of the sealing flanges.

Figure 2:
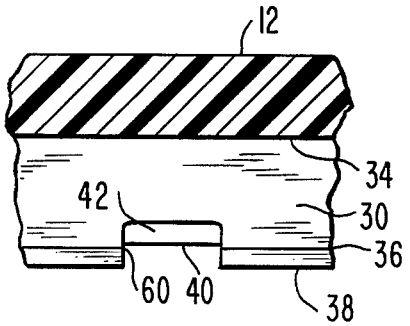
FIG. 2 is a cross-sectional view of the closure cap in FIG. 1 taken along line 2—2 of FIG. 1.

Returning now to FIGS. 1 and 2 it will be noted that each sealing flange 30 and 32 is provided with a plurality of vent slots 60 formed generally at the free end 36 of each of the sealing flanges. The width and spacing of these vent slots 60 maybe varied in accordance with the degree of venting required. The vent slots 60 have a height, in the preferred embodiment, of generally about one-third of the height of the sealing flange. While this height can also be varied, it must not be great enough to unduly increase the flexibility of the sealing flanges or to interfere with the proper contact of the sealing flanges with the container neck finish. As was discussed previously, these vent slots 60, which are preferably located opposite each other on the inner and outer sealing flanges, will provide a path for the passage of high pressure gases out of a pressurized container, to which the closure cap may be applied, as the closure cap is being removed. This will allow the pressure in the container to start to be released before the closure screw threads have become completely separated from the container's screw threads. Thus the vent slots 60 provide a safer, more gradual pressure release which is also effective in reducing the tendancy of carbonated beverages in containers to overflow when the closure cap is removed.

A plurality of anti-doming ribs 70 are also formed on the inner surface 34 of closure cap 12. These anti-doming ribs 70 prevent the pressure of a carbonated beverage or the like in a container to which the closure in accordance with the present invention may be applied from causing the cap top 12 to bulge or dome outwardly into a convex shape. In the preferred embodiment, these anti-doming ribs 70 have a height of up to 0.060" and extend radially outwardly from the center of cap top 12 in a manner similar to the spokes on a wheel. Each such anti-doming rib 70 extends radially outwardly until it abuts an inner surface 72 of inner seal back up flange 40. As such, these anti-doming ribs 70 also function to reinforce the inner seal back up flange 40 and stiffen it.

The plastic container closure cap in accordance with the present invention provides several features which render the cap particularly useful in forming a tight, reliable seal. Increase of the horizontal seal interference width with increased cap size compensates for increased seal flange flexibility as the cap size increases and ensures sufficient seal flange contact area over varying cap sizes. The use of the seal back up abutment surfaces which are contacted by the free ends of the seal flanges, and which limit the outward deformation of the seal flanges, ensure that the seal flanges wrap around the container mouth and have more than a mere line contact with the container neck finish. The load stop ring allows the closure cap to support the top loading required by bottlers without seal failure. The vent slots in the seal flanges add a safety and convenience feature and the anti-doming ribs prevent the cap from bulging outwardly. Each of these features individually and in combination enhances the closure cap and makes it particularly suited for useage in situations which require a tight seal such as with carbonated beverage containers.

While a preferred embodiment of a plastic closure cap for use with a container in accordance with the present invention has been set forth and described fully and completely hereinabove, it will be obvious to one of skill in the art that a number of changes in, for example, the type of screw threads, the inclusion of various tamper evident means, the types of materials used, and the like could be made without departing from the true spirit and scope of the invention and that the invention is accordingly to be limited only by the following claims.

I claim:

1. A plurality of closure caps having a range of sizes for use with containers having a corresponding range of mouth sizes, each said closure cap comprising:

a generally circular cap top having a generally planar outer surface and an inner surface;

a generally cylindrical side wall joined at a first end to a peripheral portion of said cap top and including means for securing said closure cap to a container;

a pair of radially spaced, inner and outer, downwardly extending circumferential sealing flanges, each of said sealing flanges being joined at a first end to said inner surface of said cap top, said inner and outer sealing flanges each having a free end with said free ends being spaced from each other at a distance greater than the spacing of said first ends of said sealing flanges, a radially outer surface of said inner flange and a radially inner surface of said outer flange engaging inner and outer edge portions, respectively of the container mouth;

a horizontal seal interference distance, said distance being the horizontal offsets between the points of attachment of said radially outer surface of said inner flange and said radially inner surface of said outer flange to said inner surface of said cap top and said inner and outer edge portions of the container mouth, said horizontal seal interference distance varying proportionally with said closure cap size in said range of closure cap sizes; and, inner and outer sealing flange back up abutment surfaces, said inner and outer abutment surfaces being engageable by said free ends of said inner and outer sealing flanges, respectively, to limit deflection of said inner and outer sealing flanges when said closure cap is secured to a container.

2. The closure cap of claim 1 wherein said inner sealing flange back up abutment surface is formed as the radially outer surface of an inner seal back up flange.

3. The closure cap of claim 2 wherein said inner seal back up flange has a thickness greater than the thickness of said inner sealing flange.

4. The closure cap of claim 2 wherein said inner sealing flange back up abutment surface is generally perpendicular to said inner surface of said closure cap top.

5. The closure cap of claim 1 wherein said outer sealing flange back up abutment surface is formed as a portion of said cylindrical side wall of said closure cap.

6. The closure cap of claim 5 wherein said outer sealing flange back up abutment surface is formed generally at said first end of said cylindrical side wall.

7. The closure cap of claim 5 wherein said outer abutment surface is generally perpendicular to said inner surface of said closure cap top.

8. The closure cap of claim 1 further including anti-doming ribs on said inner surface of said closure cap top.

9. The closure cap of claim 8 wherein said anti-doming ribs extend radially outwardly from a central portion of said inner surface of said closure cap top.

10. A closure cap for use with a container having an open mouth, said closure cap comprising:

a generally circular cap top having a generally planar outer surface and an inner surface;

a generally cylindrical side wall joined at a first end to a peripheral portion of said cap top and including means for securing said closure cap to a container;

a pair of spaced, inner and outer, downwardly extending sealing flanges, each of said sealing flanges being joined at a first end to said inner surface of said cap top, said inner and outer sealing flanges each having a free end with said free ends being spaced from each other at a distance greater than the spacing of said first ends of said sealing flanges;

inner and outer sealing flange back up abutment surfaces, said inner and outer abutment surfaces being engageable by said free ends of said inner and outer sealing flanges, respectively, to limit deflection of said inner and outer sealing flanges when said closure cap is secured to a container; and a load stop ring, said load stop ring being positioned on said inner surface of said cap top intermediate, and spaced from said spaced inner and outer sealing flanges and extending downwardly between said inner and outer sealing flanges.

11. The closure cap of claim 10 wherein said load stop ring is formed integrally with said inner surface of said closure cap top.

12. The closure cap of claim 10 wherein said load stop ring includes a planar surface engageable with a container mouth when said closure cap is secured to a container.

13. A closure cap for use with a container, said closure cap comprising:

a generally circular cap top having a generally planar outer surface and an inner surface;

a generally cylindrical side wall joined at a first end to a peripheral portion of said cap top and including means for securing said closure cap to a container;

a pair of spaced, inner and outer, downwardly extending sealing flanges, each of said sealing flanges being joined at a first end to said inner surface of said cap top, said inner and outer sealing flanges each having a free end with said free ends being spaced from each other at a distance greater than the spacing of said first ends of said sealing flanges;

a plurality of vent slots in each of said sealing flanges; and, inner and outer sealing flange back up abutment surfaces, said inner and outer abutment surfaces being engageable by said free ends of said inner and outer sealing flanges, respectively, to limit deflection of said inner and outer sealing flanges when said closure cap is secured to a container.

14. The closure cap of claim 13 wherein each of said vent slots is formed generally at the free end of each of said sealing flanges.

15. The closure cap of claim 14 wherein each of said vent slots has a length generally about one third of the length of each of said sealing flanges.

16. The closure cap of claim 13 wherein said vent slots on said inner and outer sealing flanges are radially aligned.

* * * * *